US010674812B2

(12) United States Patent
Sorrentino

(10) Patent No.: US 10,674,812 B2
(45) Date of Patent: Jun. 9, 2020

(54) ORAL CARE IMPLEMENT AND A METHOD OF FORMING A BRISTLE FIELD FOR AN ORAL CARE IMPLEMENT

(71) Applicant: Colgate-Palmolive Company, New York, NY (US)

(72) Inventor: Alan Sorrentino, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 404 days.

(21) Appl. No.: 15/521,366

(22) PCT Filed: Oct. 23, 2014

(86) PCT No.: PCT/US2014/061959

§ 371 (c)(1),
(2) Date: Apr. 24, 2017

(87) PCT Pub. No.: WO2016/064401

PCT Pub. Date: Apr. 28, 2016

(65) Prior Publication Data

US 2017/0311711 A1 Nov. 2, 2017

(51) Int. Cl.

| | |
|---|---|
| ***A46D 1/08*** | (2006.01) |
| ***A46D 3/04*** | (2006.01) |
| ***A46B 3/04*** | (2006.01) |
| *A46B 9/04* | (2006.01) |

(52) U.S. Cl.
CPC ..... *A46D 1/08* (2013.01); *A46B 3/04* (2013.01); *A46D 3/045* (2013.01); *A46B 9/04* (2013.01); *A46B 2200/1066* (2013.01)

(58) Field of Classification Search
CPC ..... A46D 1/08; A46D 3/045; A46B 3/04
USPC ..... 300/21
See application file for complete search history.

(56) References Cited

U.S. PATENT DOCUMENTS

| | | | | |
|---|---|---|---|---|
| 3,136,582 A * | 6/1964 | Lorenz Locher | ..... | A46D 3/045 15/193 |
| 4,749,233 A | 6/1988 | Weihrauch | | |
| 5,033,797 A | 7/1991 | Rueb | | |
| 5,474,366 A * | 12/1995 | Strutt | ..... | A46D 3/005 300/21 |

(Continued)

FOREIGN PATENT DOCUMENTS

| | | |
|---|---|---|
| DE | 101 08 339 | 8/2002 |
| JP | S61-280805 | 12/1986 |
| JP | 2006-174905 | 7/2006 |

OTHER PUBLICATIONS

International Search Report and the Written Opinion of the International Searching Authority issued in international application PCT/US2014/061959 dated Aug. 31, 2015.

*Primary Examiner* — Laura C Guidotti

(57) ABSTRACT

A method of forming a bristle field for an oral care implement. The method includes providing a bundle of bristles and aligning the bundle of bristles with an insertion opening in a guide member. Upon insertion into the guide member, the guide member divides the bundle of bristles into a plurality of bristle tufts. The guide member can be aligned with tuft holes on a head or head plate of an oral care implement so that the bundle of bristles can be inserted through the guide member and into the tuft holes. As a result, a single bundle of bristles can be used to mount a plurality of bristle tufts to the head or head plate.

3 Claims, 12 Drawing Sheets

(56) References Cited

U.S. PATENT DOCUMENTS

| | | | | |
|---|---|---|---|---|
| 5,535,474 | A | 7/1996 | Salazar | |
| 5,850,660 | A | 12/1998 | O'Halloran | |
| 6,021,538 | A | 2/2000 | Kressner et al. | |
| 6,314,605 | B1 | 11/2001 | Solanki et al. | |
| 6,588,851 | B1 | 7/2003 | Bible et al. | |
| 6,957,468 | B2 | 10/2005 | Driesen et al. | |
| 9,066,579 | B2 | 6/2015 | Hess et al. | |
| 2003/0132661 | A1 | 7/2003 | Sato et al. | |
| 2004/0107521 | A1 | 6/2004 | Chan et al. | |
| 2007/0006410 | A1* | 1/2007 | Kraemer ..... | A46B 3/04 15/167.1 |
| 2007/0271717 | A1 | 11/2007 | Clos et al. | |
| 2008/0012420 | A1 | 1/2008 | Boucherie | |
| 2010/0066154 | A1 | 3/2010 | Boucherie | |
| 2010/0263148 | A1 | 10/2010 | Jimenez et al. | |
| 2010/0275397 | A1 | 11/2010 | Moskovich et al. | |
| 2011/0030160 | A1 | 2/2011 | Knutzen et al. | |
| 2012/0013169 | A1 | 1/2012 | Rees | |
| 2014/0338140 | A1 | 11/2014 | Ji | |
| 2015/0130259 | A1 | 5/2015 | Birk | |

* cited by examiner

ORAL CARE IMPLEMENT AND A METHOD OF FORMING A BRISTLE FIELD FOR AN ORAL CARE IMPLEMENT

BACKGROUND

Toothbrushes are generally manufactured by forming a handle and a head via an injection molding process and then attaching bristles to the head of the toothbrush. The number of toothbrushes that can be manufactured in a given amount of time is limited by the number of bristle tufts that can be coupled to the head in the given amount of time. Machines that currently attach bristles to toothbrushes are capable of operating at a maximum speed of approximately 1000 tufts per minute. Conventional toothbrushes typically have around 30-40 bristle tufts on the head, such that conventional machines are able to attach the bristle tufts to approximately 25-30 toothbrushes per minute. In order to produce a desirable number of toothbrushes per minute, each toothbrush is limited in the number of tufts that it can have on the head. Thus, a need exists for a method of forming a bristle field for an oral care implement that expedites the process and potentially allows for more tufts to be provided on the head without compromising the quantity of toothbrushes produced in a given amount of time.

BRIEF SUMMARY

The present invention is directed to a method of forming a bristle field for an oral care implement. The method includes providing a bundle of bristles and aligning the bundle of bristles with an insertion opening in a guide member. Upon insertion into the guide member, the guide member divides the bundle of bristles into a plurality of bristle tufts. The guide member can be aligned with tuft holes on a head or head plate of an oral care implement so that the bundle of bristles can be inserted through the guide member and into the tuft holes. As a result, a single bundle of bristles can be used to mount a plurality of bristle tufts to the head or head plate.

In one aspect, the invention can be a method of forming a bristle field for an oral care implement, the method comprising: a) providing a bundle of bristles; b) aligning the bundle of bristles with an insertion opening in a first surface of a guide member, the guide member comprising at least one bristle distribution passageway comprising a funnel section and a plurality of delivery passageways, each of the delivery passageways extending from the funnel section and terminating in a delivery opening on a second surface of the guide member, wherein adjacent ones of the delivery passageways are separated from one another by a divider, the funnel section comprising the insertion opening, wherein the guide member is aligned with a head plate of the oral care implement such that each of the delivery openings is aligned with a different tuft hole of the head plate; and c) inserting the bundle of bristles through the bristle distribution passageway so that the bundle of bristles passes through the funnel section and is divided into a plurality of bristle tufts as a result of contact with the divider, each of the bristle tufts passing through a different one of the delivery passageways and into a different one of the tuft holes.

In another aspect, the invention can be a method of forming a bristle field for an oral care implement, the method comprising: a) providing a bundle of bristles; b) aligning the bundle of bristles with an insertion opening in a first surface of a head plate, the head plate comprising at least one bristle distribution passageway comprising a plurality of delivery passageways, each of the delivery passageways terminating in a delivery opening on a second surface of the head plate, wherein adjacent ones of the delivery passageways are separated from one another by a divider, each of the delivery passageways forming a tuft hole on the head plate; and c) inserting the bundle of bristles through the bristle distribution passageway so that the bundle of bristles is divided into a plurality of bristle tufts as a result of contact with the divider, each of the bristle tufts passing into a different one of the tuft holes on the head plate.

In yet another aspect, the invention can be a method of forming a bristle field for an oral care implement, the method comprising: a) providing a bundle of bristles; b) aligning the bundle of bristles with an insertion opening in a first surface of a guide member, the guide member comprising at least one bristle distribution passageway comprising a plurality of delivery passageways, each of the delivery passageways terminating in a delivery opening on a second surface of the guide member, wherein adjacent ones of the delivery passageways are separated from one another by a divider; c) aligning the guide member with a head plate of the oral care implement such that each of the delivery openings is aligned with a different tuft hole of the head plate; and d) inserting the bundle of bristles through the bristle distribution passageway so that the bundle of bristles is divided into a plurality of bristle tufts as a result of contact with the divider, each of the bristle tufts passing through a different one of the delivery passageways and into a different one of the tuft holes.

In a further aspect, the invention can be an oral care implement comprising: a handle; a head having a first surface, a plurality of tuft holes formed into the first surface of the head, each of the tuft holes having a diameter $D_{TH}$, the tuft holes arranged in a tuft hole pattern such that a singular bounded area $A_B$ of the first surface can be selected that includes X number of tuft holes; and wherein X is an integer that is greater than or equal to 2, $D_{TH}$ is less than or equal to 1.1 mm, and $X/A_B$ is greater than or equal to 0.54.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
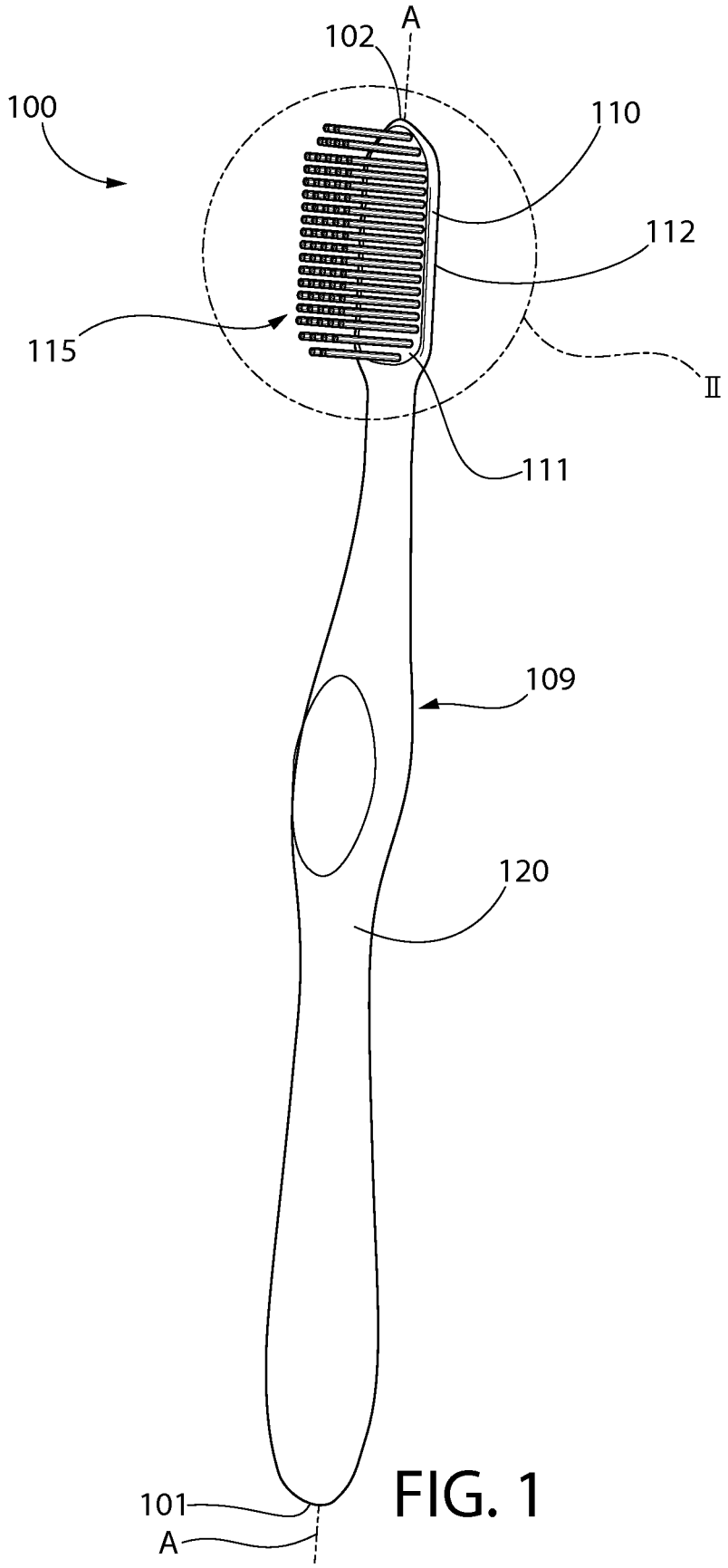
FIG. 1 is a front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
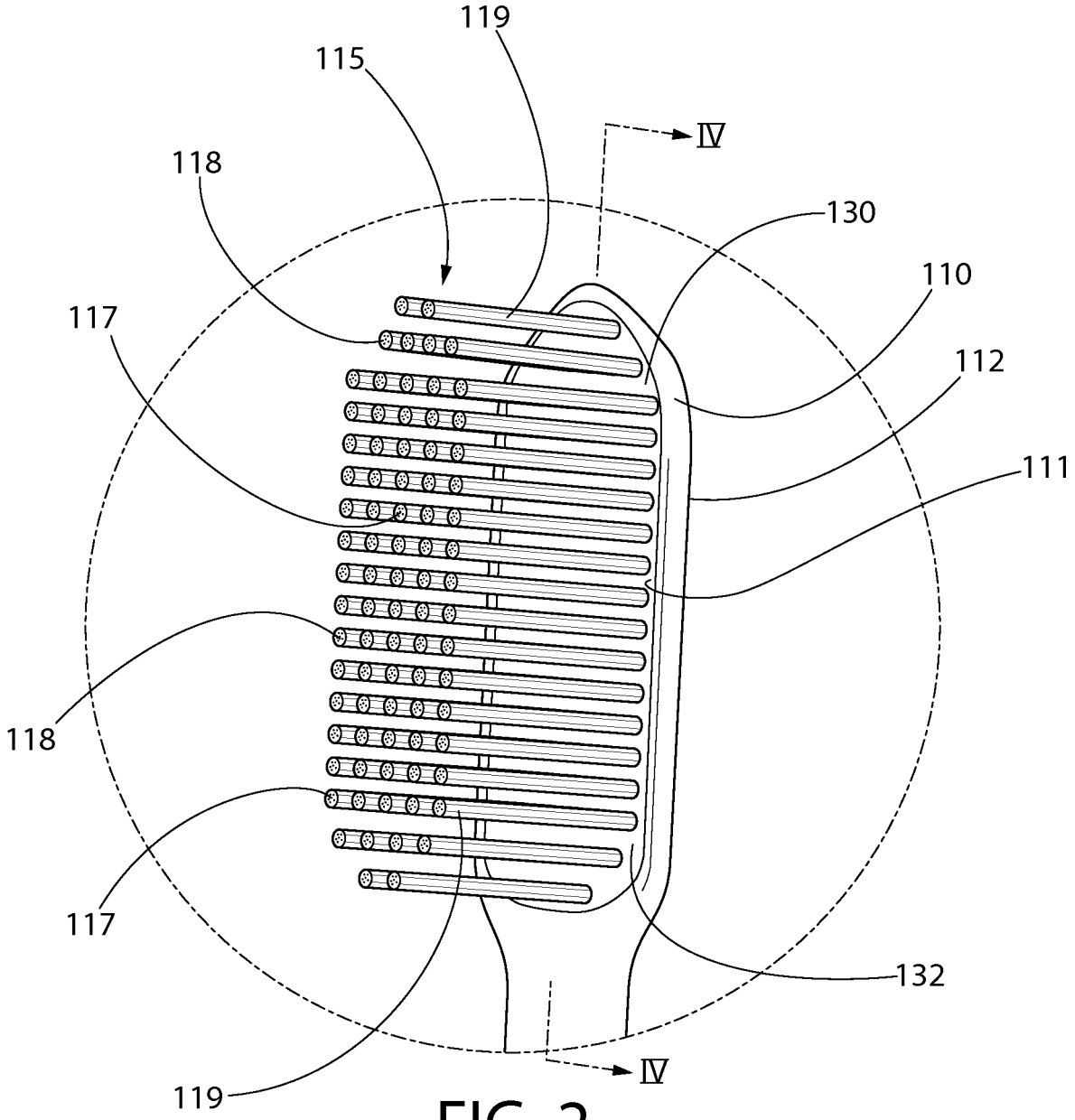
FIG. 2 is a close-up view of area II of FIG. 1 showing a head of the oral care implement.
Figure 3:
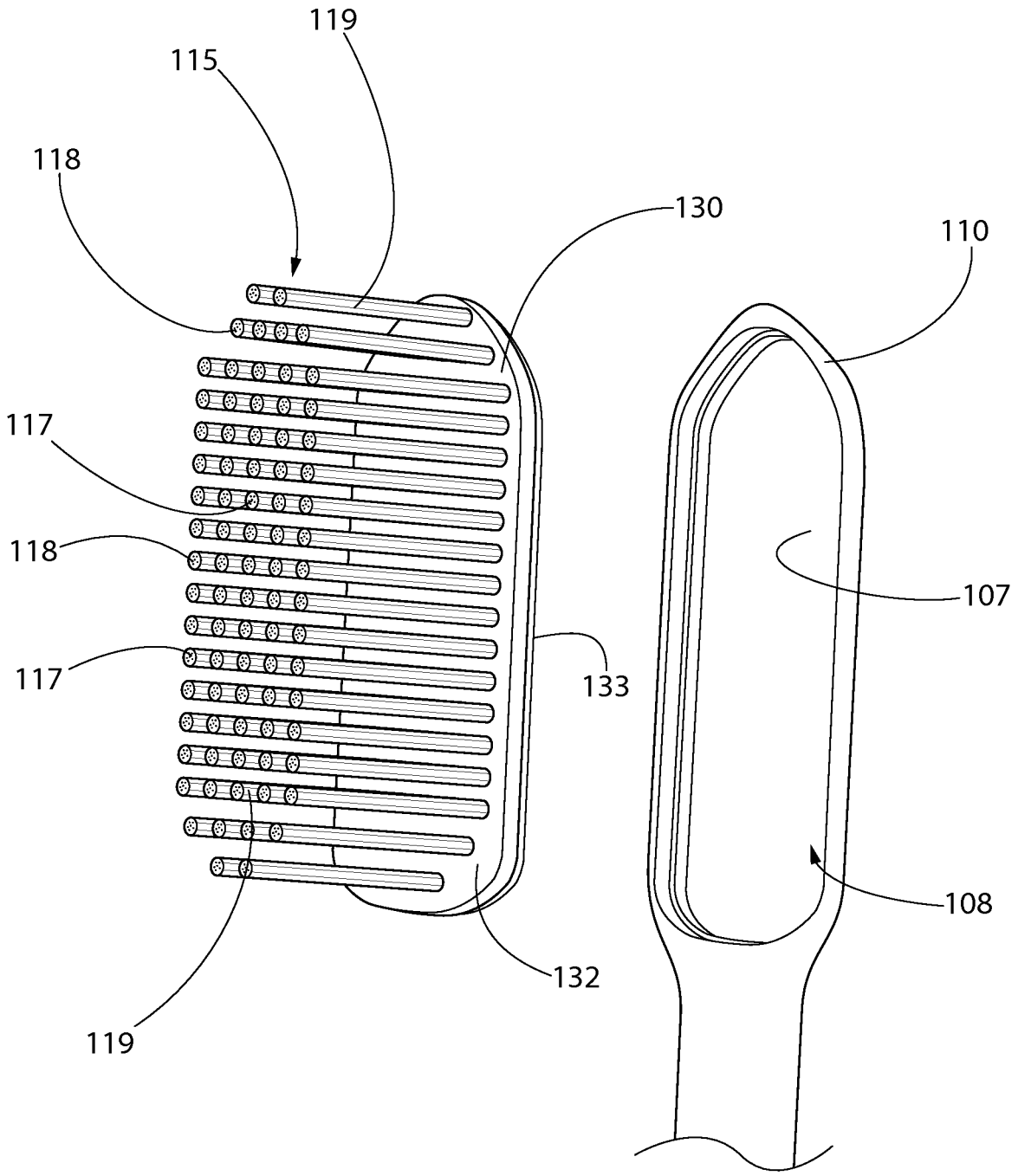
FIG. 3 is an exploded view of the head of the oral care implement of FIG. 2.

Referring first to FIGS. 1 and 2 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement 100 extends from a proximal end 101 to a distal end 102 along a longitudinal axis A-A. The oral care implement 100 generally comprises a head 110 and a handle 120. The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood, or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment, the head 110 is formed integrally with the handle 120 as a single unitary structure using a molding, milling, machining, or other suitable process. In one particular embodiment, the handle 120 and the head 110 can be formed integrally during a single shot of an injection molding process. Thus, in the exemplified embodiment the oral care implement 100 may be considered to comprise a body 109 that includes the handle 120 and the head 110. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. Where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring now to FIGS. 1-4 concurrently, one manner in which the tooth cleaning elements 115 are secured to the head 110 will be described. Specifically, in the exemplified embodiment the tooth cleaning elements 115 are formed as a cleaning element assembly on a head plate 130 such that one or more of the tooth cleaning elements 115 are mounted onto the head plate 130 and then the head plate 130 is coupled to the head 110. In such an embodiment, the head plate 130 is a separate and distinct component from the head 110 of the oral care implement 100. However, the head plate 130 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, in this embodiment the head plate 130 and the head 110 are separately formed components that are secured together during manufacture of the oral care implement 100.

The head plate 130 comprises an upper surface 132 and a lower surface 133. Furthermore, the head plate 130 may comprise a plurality of tuft holes 131 formed therethrough such that the tuft holes 131 extend through the entirety of the head plate 130 from the upper surface 132 to the lower surface 133, and the tooth cleaning elements 115 may be mounted to the head plate 130 within the tuft holes 131. In certain specific embodiments, the tuft holes 131 have circular cross-sectional shapes with a diameter that is less than 1.2 mm. The technique for mounting the tooth cleaning elements 115 to the head 110 via the head plate 130 is generally known as anchor free tufting (AFT). Specifically, in AFT a plate or membrane (i.e., the head plate 130) is created separately from the head 110. The tooth cleaning elements 115 (such as bristles, elastomeric elements, and combinations thereof) are positioned into the head plate 130 so as to extend through the tuft holes 131 of the head plate 130.

The tooth cleaning elements 115 have anchor portions 116 and cleaning portions 117. The cleaning portions 117 form the free ends of the tooth cleaning elements 115 that protrude from the upper surface 132 of the head plate 130 to perform the cleaning function. Specifically, during toothbrushing the cleaning portions 117 of the tooth cleaning elements 115 are contacted against a user's teeth to scrub plaque from the user's teeth. The anchor portions 116 of the tooth cleaning elements 115 are located adjacent to the lower surface 133 of the head plate 130. After the tooth cleaning elements 155 are positioned within the tuft holes 131 so that the anchor portions 116 are positioned within and extend through the tuft holes 131 on the lower surface 133 of the head plate 130, the anchor portions 116 of the tooth cleaning elements are melted together by heat to be anchored in place. As the anchor portions 116 of the tooth cleaning elements 115 are melted together, a melt matte 106 is formed.

Figure 4:
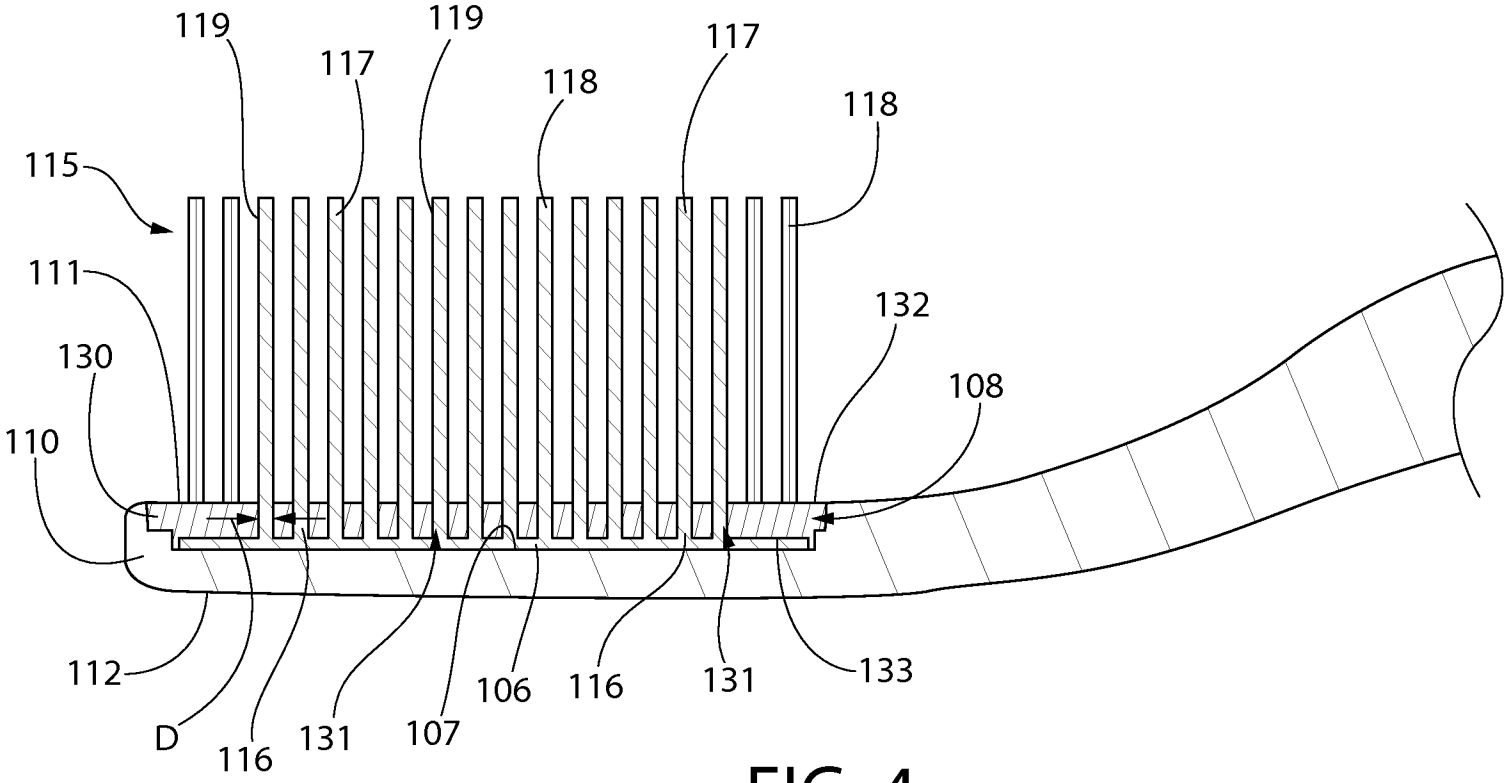
FIG. 4 is a cross-sectional view taken along line IV-IV of FIG. 2.

After the tooth cleaning elements 115 are secured to the head plate 130, the head plate 130 is secured to the head 110 such as by ultrasonic welding, as depicted in FIG. 4. When the head plate 130 is coupled to the head 110, the melt matte 106 is located between the lower surface 133 of the head plate 130 and a floor 107 of a basin 108 of the head 110 in which the head plate 130 is disposed. The melt matte 106, which is coupled directly to and in fact forms a part of the tooth cleaning elements 115, prevents the tooth cleaning elements 115 from being pulled through the tuft holes 131 in the head plate 130 to ensure that the tooth cleaning elements 105 remain attached to the head plate 130 during use of the oral care implement 100. The manner in which the tooth cleaning elements 115 are inserted into the tuft holes 131 and become coupled to the head plate 130 will be discussed in more detail below with reference to FIGS. 5A-5D.

In the embodiment of FIGS. 1-4, the oral care implement 100 has 82 tuft holes 131 and therefore also 82 separate and distinct bristle tufts thereon. Specifically, in the embodiment of FIGS. 1-4, the tooth cleaning elements 115 includes a plurality of bristle tufts 118, each of which is positioned within one of the tuft holes 131. Furthermore, each of the bristle tufts 118 comprises or is formed from a plurality of individual bristle filaments. Each of the tuft holes 131 is spaced apart from adjacent ones of the tuft holes 131 such that there are 82 distinct, isolated, and separate tuft holes on the head 110 (or head plate 130) of the oral care implement 100. Furthermore, each of the bristle tufts 118 has an outer surface 119 that is spaced apart from the outer surfaces 119 of all adjacent bristle tufts 118. Thus, in the exemplified embodiment, each of the bristle tufts 118 is spatially isolated from adjacent ones of the bristle tufts along an entire length of the bristle tufts 118. Of course, the invention is not to be so limited in all embodiments and the bristle tufts 118 may extend from different tuft holes 131 but be angled or inclined into contact with one another in some embodiments. In the exemplified embodiment, each of the bristle tufts 118 is cylindrical in shape and the outer surfaces 119 of each bristle tuft 118 forms a continuously closed wall. Furthermore, the spaces between adjacent ones of the bristles tufts 118 renders each of the bristle tufts 118 distinct from one another in their extension from the head 110 or head plate 130. Of course, the invention is not limited to the bristle tufts 118 being cylindrical and forming a continuously closed wall in all embodiments, and in certain other embodiments the bristle tufts 118 may have other shapes, such as conical, or having other polygonal cross-sectional shapes including triangular, square, or the like. Furthermore, in other embodiments the outer surfaces 119 of the bristle tufts 118 may include gaps rather than forming a continuously closed wall.

The 82 separate and distinct tuft holes 131 and bristle tufts 118 is a greater number of tuft holes and bristle tufts than in conventional oral care implements, which typically include between 30 and 40 tuft holes on the head. This additional number of tuft holes is possible by creating the tuft holes 131 with a diameter D of less than 1.2 mm and by forming the bristle field using the technique described below with reference to FIGS. 5-6D. As the tuft holes 131 are described herein as having a diameter D, it should be appreciated that in certain preferred embodiments the tuft holes 131 are round or have circular cross-sectional shapes. In some embodiments, the diameter D of the tuft holes 131 is between 0.6 mm and 1.2 mm, more specifically between 0.8 mm and 1.2 mm, still more specifically between 1.0 mm and 1.2 mm, and even more specifically between 1.05 mm and 1.15 mm. Furthermore, although exemplified herein with 82 of the tuft holes 131 and bristle tufts 118, the invention is not to be so limited and the oral care implement 100 (or the head plate 130) may include between 60 and 85 of the tuft holes 131 and bristle tufts 118, more specifically between 65 and 80 of the tuft holes 131 and bristle tufts 118, and still more specifically between 70 and 75 of the tuft holes and bristle tufts 118. In another embodiment, the oral care implement 100 may include between 80 and 85 of the tuft holes 131 and bristle tufts 118. In yet another embodiment the oral care implement 100 may include between 75 and 80 of the tuft holes 131 and bristle tufts 118. In still another embodiment the oral care implement 100 may include more than 80 the tuft holes 131 and bristle tufts 118.

Figure 7A:
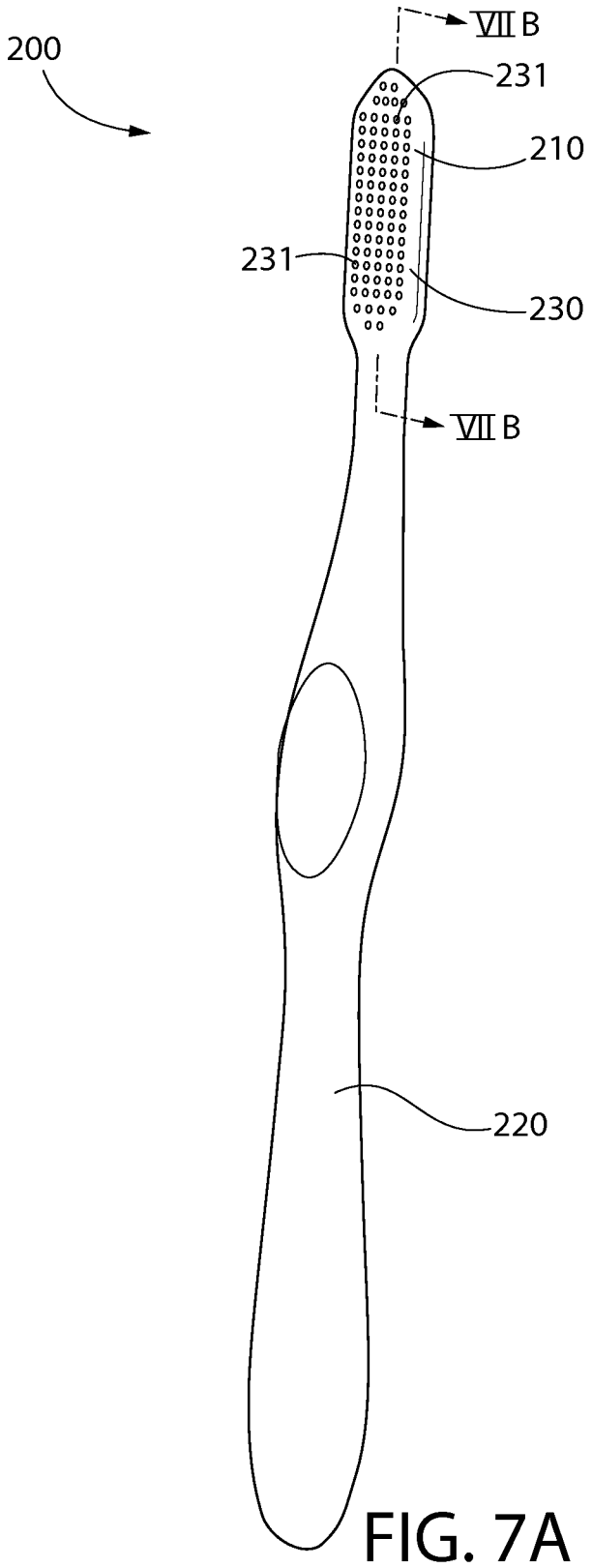
FIG. 7A is a perspective view of an oral care implement in accordance with another embodiment of the present invention, wherein the oral care implement includes a handle and a head.
Figure 7B:
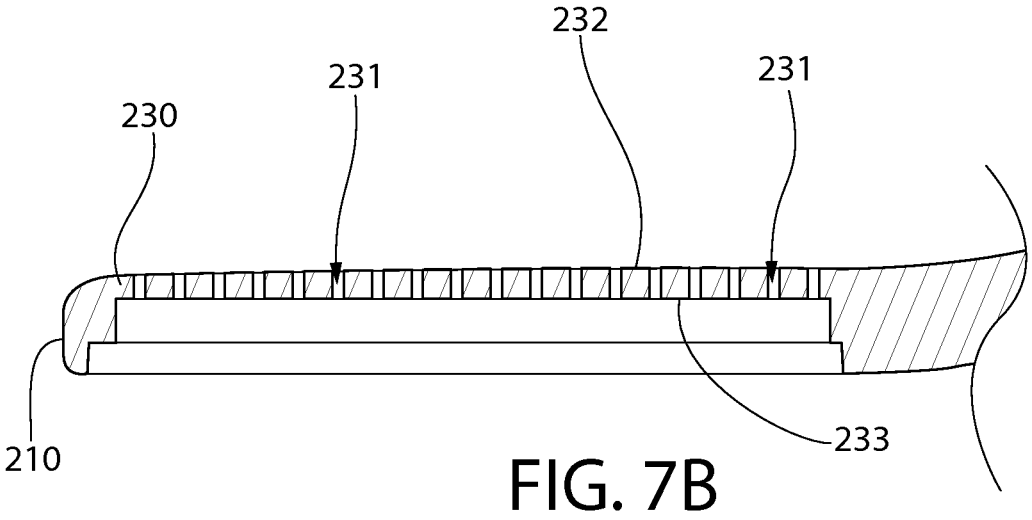
FIG. 7B is a cross-sectional view taken along line VIIB-VIIB of FIG. 6A.
Figure 7C:
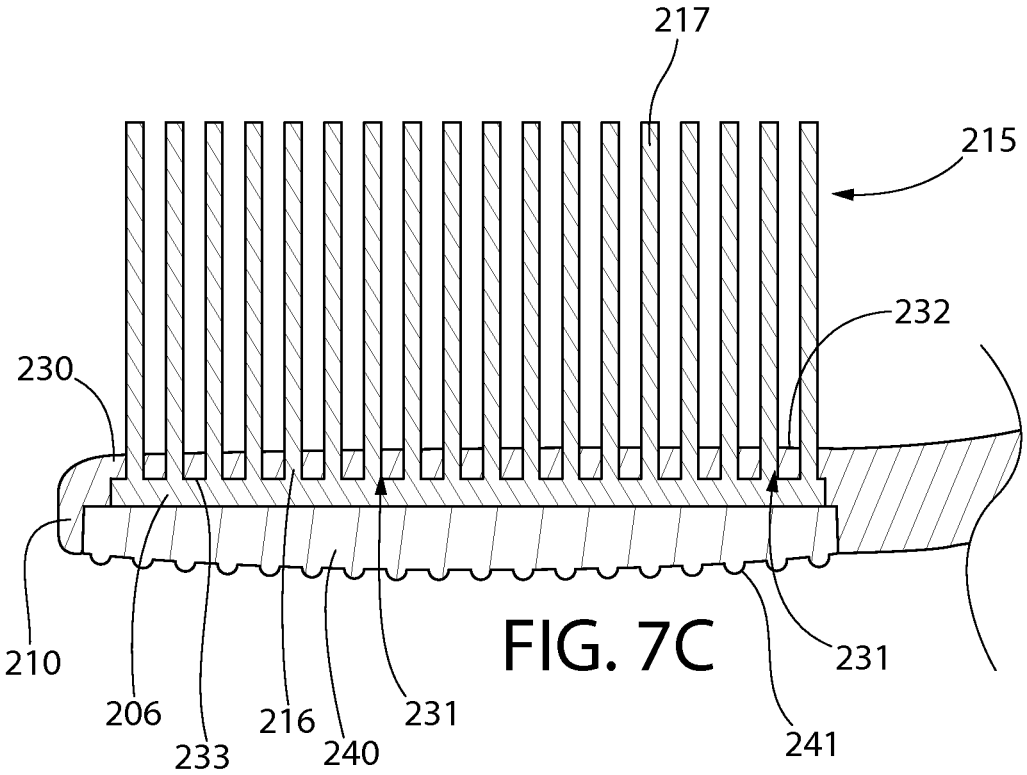
FIG. 7C is an illustration of the cross-sectional view of FIG. 7B with bristles and a tongue cleaner attached to the head.

Referring briefly to FIGS. 7A-7C, an oral care implement 200 having a handle 220 and a head 210 is illustrated to show another manner in which the manufacturing process may take place. Specifically, in the embodiment of FIGS. 7A-7C, tooth cleaning elements 215 may be connected to the head 210 using a technique known in the art as AMR, which is another anchor or staple-free tufting technique. In this technique, the handle 220 is formed integrally with the head plate 230 as a one-piece structure. The handle 220 and the head plate 230 can be formed in a single shot during an injection molding process. Thus, rather than the head plate being separate from the handle and head as with the embodiment of FIGS. 1-4, the head plate 230 is directly coupled to the handle 220. The head plate 230 has a plurality of tuft holes 231 extending therethrough. After the handle 220 and the head plate 230 are formed, the tooth cleaning elements 215 are inserted into the tuft holes 231 in the head plate 230 so that free/cleaning ends 217 of the tooth cleaning elements 215 extend from the front surface 232 of the head plate 230 and anchor portions 216 of the tooth cleaning elements protrude from the rear surface 233 of the head plate 230. After the tooth cleaning elements 215 are inserted into the tuft holes 231 in the head plate 230, the anchor portions 216 of the tooth cleaning elements 215 are melted together by applying heat thereto, thereby forming a melt matte 206 at or adjacent to the rear surface 233 of the head plate 230. The melt matte 206 is a thin layer of plastic that is formed by melting the anchor portions 216 of the tooth cleaning elements 215 so that the anchor portions 216 of the tooth cleaning elements 215 transition into a liquid, at which point the liquid of the anchor portions 216 of the tooth cleaning elements 215 combine together into a single layer of liquid plastic that at least partially covers the rear surface 233 of the head plate 230. After the heat is no longer applied, the melted anchor portions 216 of the tooth cleaning elements 215 solidify/harden to form the melt matte 206/thin layer of plastic.

In some embodiments, after formation of the melt matte 216, a tissue cleanser 240 may be injection molded onto the rear surface of the head plate 230, thereby trapping the melt matte 206 between the tissue cleanser 240 and the rear surface of the head plate 230. Such a tissue cleanser 240 may be formed of a thermoplastic elastomer or other soft rubber-like material, and it may include nubs 241 as depicted in FIG. 7C. An example of a suitable soft tissue cleanser that may be used with the present invention and positioned on the rear surface of the head 210 (or on the rear surface of the head 110 of FIGS. 1-4) is disclosed in U.S. Pat. No. 7,143,462, issued Dec. 5, 2006 to the assignee of the present application, the entirety of which is hereby incorporated by reference. In certain embodiments, the soft tissue cleanser may include protuberances, which can take the form of elongated ridges, nubs, or combinations thereof. In other embodiments, other structures may be coupled to the rear surface of the head plate 230 to trap the melt matte 206 between the rear surface of the head plate 230 and such structure without the structure necessarily being a tissue cleanser (the structure can just be a plastic material that is used to form a smooth rear surface of the head, or the like).

Referring now to FIGS. 5 and 6A-6D concurrently, a method of forming a bristle field for an oral care implement will be described. The method will be described herein below with regard to forming a bristle field on the head plate 130 discussed above with reference to FIGS. 1-4. However, the method is equally applicable to forming a bristle field on the head plate 230 discussed above with reference to FIGS. 7A-7C. Thus, the method described herein below with reference to FIGS. 6A-6D can be used when affixing tooth cleaning elements to a toothbrush head using any of the various anchor-free tufting techniques discussed herein above and otherwise known.

When forming a bristle field for an oral care implement, a supply of bristles 300 is provided that includes a large number of bristles or bristle filaments that can be gathered into bristle tufts and then inserted into the toothbrush head or head plate. Thus, the first step in the method is to gather, select, or provide a bundle of bristles 301 from the supply of bristles 300. Each bundle of bristles 301 may be a "pick" or "tuft pick" as those terms are used in the toothbrush manufacturing art. In conventional bristle field forming techniques, each bundle of bristles 301 is equated to one bristle tuft on the toothbrush head or multiple bundles of bristles 301 are combined together to form one bristle tuft on the toothbrush head. Thus, the number of bristle tufts on the head is limited by the speed at which the bundles of bristles 301 can be selected from the supply of bristles 300 and inserted into the head. As a result, using conventional techniques, in order to meet quantity demands during toothbrush manufacture, toothbrushes have heretofore been limited in the number of bristle tufts that are on the head.

In accordance with the present invention, the bundle of bristles 301 are inserted into the head 110 or head plate 130 of the oral care implement 100 through an intermediary guide member 400. The details of the guide member 400 will be described with particular reference to FIGS. 5 and 6A. The guide member 400 has a first surface 401 and an opposing second surface 402. Furthermore, the guide member 400 has an insertion opening 403 in the first surface 401 and a bristle distribution passageway 410 that comprises the insertion opening 403. In the exemplified embodiment, the guide member 400 only includes one bristle distribution passageway 410. However, the invention is not to be so limited and the guide member 400 may include a plurality of the bristle distribution passageways, 410, such as two, three, four, five, or more of the bristle distribution passageways 410 as desired. As will be discussed below, each of the bristle distribution passageways 410 divides one of the bundles of bristles 301 into a plurality of bristle tufts 118 (see FIG. 6A) that can be inserted into separate tuft holes on the head 110 or head plate 130. Thus, using the guide member 400, one bundle of bristles 301 can be used to form several of the bristle tufts 118 that are mounted within different tuft holes on the head. As a result, a plurality of the bristle tufts 118 can be positioned on and mounted to the head plate 130 within the tuft holes 131 in the same amount of time that it takes to create a single bristle tuft on the head using conventional bristle field forming techniques.

Figure 5:
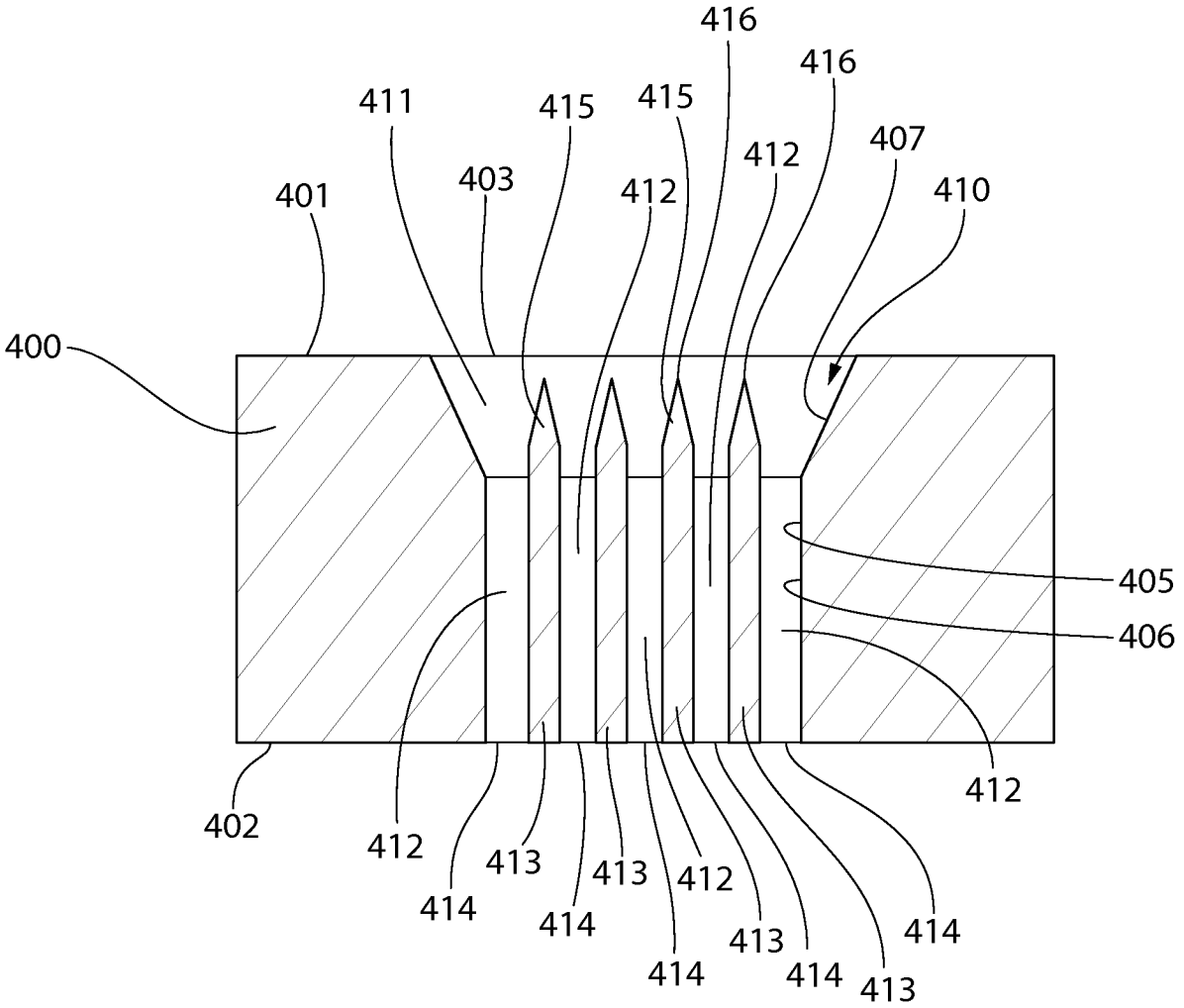
FIG. 5 is a schematic cross-sectional view of a guide member in accordance with an embodiment of the present invention.
Figure 6A:
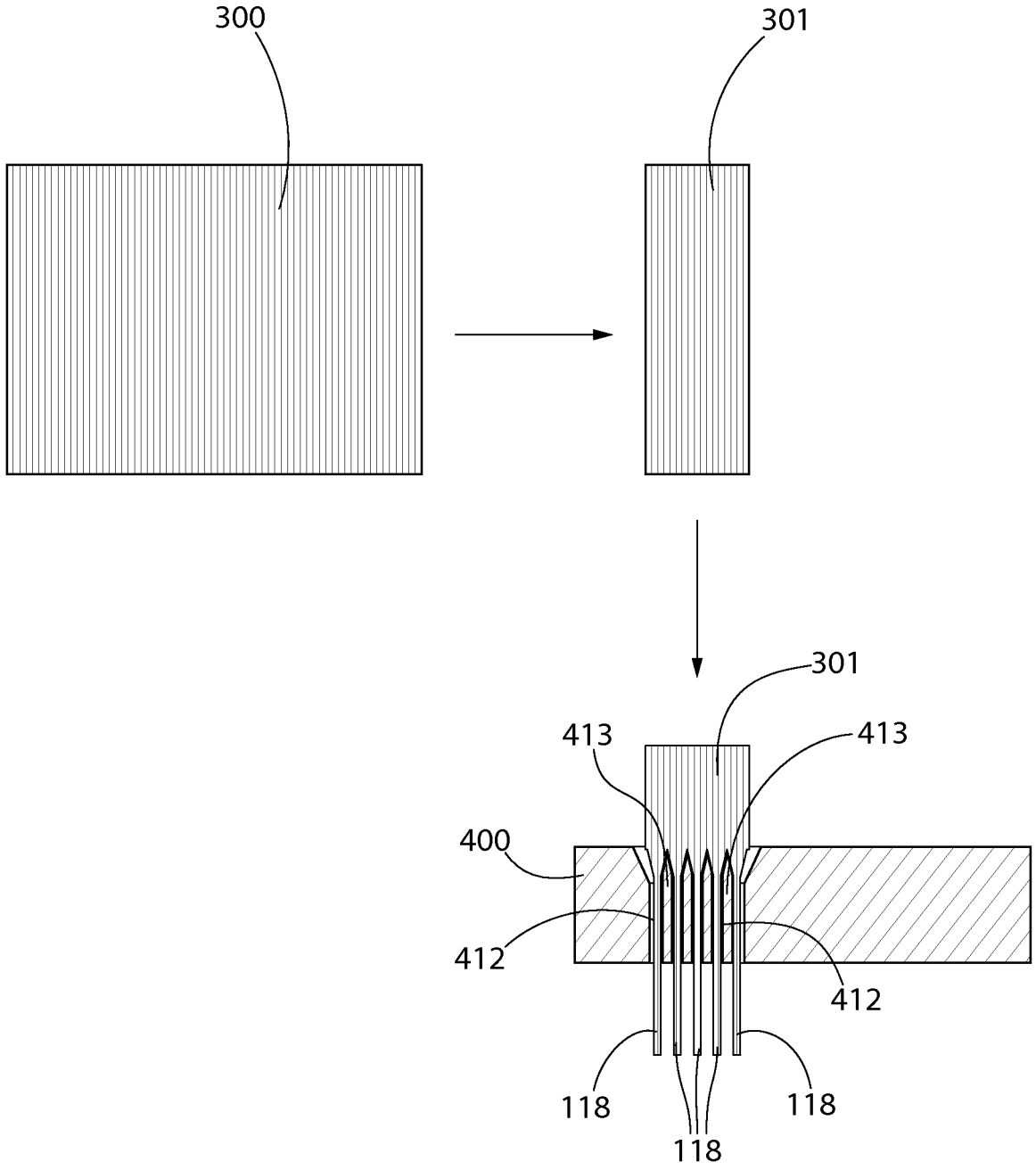
FIG. 6A is a schematic representation of providing a bundle of bristles and inserting the bundle of bristles into the guide member to divide the bundle of bristles into a plurality of bristle tufts.

Still referring to FIGS. 5 and 6A concurrently, the bristle distribution passageway 410 comprises a funnel section 411 and a plurality of delivery passageways 412. The funnel section 411 is formed by a chamfer that causes the cross-sectional area of the bristle distribution passageway 410 to increase from the beginning of the chamfer to the insertion opening 403. Stated another way, the guide member 400 has an inner surface 405 that defines or surrounds the bristle distribution passageway 410. The inner surface 405 has a delivery section 406 and an insertion section 407, the insertion section 407 extending from the delivery section 406 to the insertion opening 403. Thus, the funnel section 411 has an angled/chamfered wall (i.e., insertion section 407) that facilitates feeding the bristles of the bundle of bristles 301 into the bristle distribution passageway 410.

The bristle distribution passageway 410 is divided into the plurality of delivery passageways 412 by a plurality of dividers 413. Each of the delivery passageways 412 extends from the funnel section 411 and terminates in a delivery opening 414 on the second surface 402 of the guide member 400. Specifically, in the exemplified embodiment adjacent ones of the delivery passageways 412 are separated from one another by one of the dividers 413. In the exemplified embodiment, four dividers 413 are provided in the bristle distribution passageway 410 to divide the bristle distribution passageway 410 into five delivery passageways 412. However, the invention is not to be so limited and any of one or more of the dividers 413 may be used to divide the bristle distribution passageway 410 into two or more delivery passageways 412.

In the exemplified embodiment, the dividers 413 have a tapered section 415 (only some of which are labeled to avoid clutter) such that the dividers 413 taper to a tip or point 416 (only some of which are labeled to avoid clutter) that is located near or adjacent to the insertion opening 403. In the exemplified embodiment, the tips 416 are positioned within the funnel section 411 and spaced a small distance from the insertion opening 403. However, the tips 416 may be located at the insertion opening 403 or otherwise in other embodiments. Furthermore, although described herein as having tapered sections 415 and tips 416, the exact shape of the dividers 413 is not to be limiting in all embodiments and the tapered section 415 may be omitted in some embodiments. However, tapering the dividers 413 to form tips 416 near the insertion opening 403 facilitates the separation/division of the bundle of bristles 301 into distinct bristle tufts 118 as discussed below.

Still referring to FIGS. 5 and 6A concurrently, the bristle field forming process will be described. During the bristle field forming process, the bundle of bristles 301 that has been selected from the supply of bristles 300 is collectively inserted into the bristle distribution passageway 410 of the guide member 400. Specifically, the bundle of bristles 301 is aligned with the insertion opening 403 in the first surface 401 of the guide member 400. Next, the bundle of bristles 301 is inserted through the insertion opening 403 and into the funnel section 411 of the bristle distribution passageway 410. While within the funnel section 411 of the bristle distribution passageway 410, the bundle of bristles 301 contacts the dividers 413. More specifically, the tips 416 and tapered sections 415 of the dividers 413 contacts the bundle of bristles 301 and causes the bundle of bristles 301 to separate into multiple bristle tufts 118 such that each of the bristle tufts 118 is positioned within one of the delivery passageways 412 and adjacent ones of the bristle tufts 118 are separated from one another by the dividers 413. Thus, as the bundle of bristles 301 is inserted into the bristle distribution passageway 410 of the guide member 400, the bundle of bristles 301 is divided into a plurality of the bristle tufts 118, each of which is positioned within and passes through a different one of the delivery passageways 412 as the bundle of bristles 301 continues to be moved through the bristle distribution passageway 410 in a direction from the first surface 401 of the guide member 400 to the second surface 402 of the guide member 400.

Figure 6B:
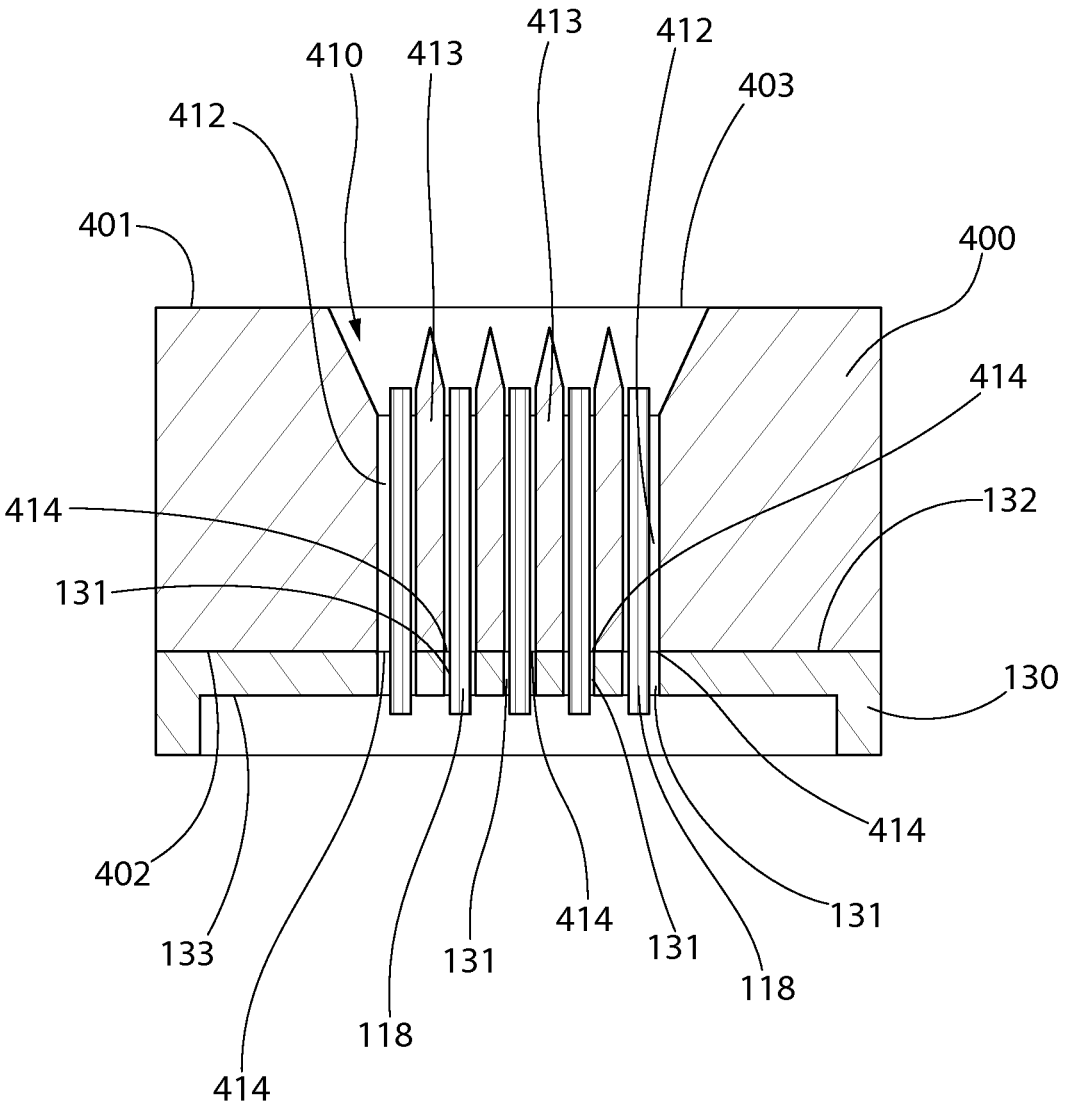
FIG. 6B is a schematic representation of the bundle of bristles positioned within the guide member and each of the plurality of bristle tufts being inserted into a different tuft hole in a head plate.

Referring to FIG. 6B, the method for forming the bristle field for the oral care implement will be further described. As can be seen in FIG. 6B, during the process of mounting the bristles to the head plate 130, the guide member 400 is aligned with the head plate 130. More specifically, the second surface 402 of the guide member 400 is positioned adjacent to or into contact with the upper surface 132 of the head plate 130 so that the delivery openings 414 are aligned with the tuft holes 131 on the head plate 130. In certain embodiments, the delivery openings 414 of the delivery passageways 412 have the same size, shape, and dimensions and the spacing between adjacent ones of the delivery openings 414 is identical to the spacing between adjacent ones of the tuft holes 131 on the head plate 130. As a result, in the exemplified embodiment when the guide member 400 is aligned with the head plate 130, each one of the delivery openings 414 is perfectly aligned with one of the tuft holes 131 on the head plate 130. Of course, the invention is not to be so limited in all embodiments and the delivery openings 414 may be smaller than the tuft holes 131 in certain embodiments, but still positioned so that the cross-sectional area of the delivery openings 414 are aligned with the cross-sectional area of the tuft holes 131 so that each one of the bristles of the bristle tufts 118 can be fed directly from the delivery passageways 412 into the tuft holes 131.

The guide member 400 can either be aligned with the head plate 130 prior to inserting the bundle of bristles 301 into the insertion opening 403 of the guide member 400 or after the bundle of bristles 301 has been inserted into the insertion opening 403 of the guide member 400. However, it may be desirable to align the guide member 400 with the head plate 130 before the bristle tufts 118 begin to protrude through the delivery openings 414 in the second surface 402 of the guide member 400. When aligning the guide member 400 with the head plate 130, it may be important to align the delivery openings 414 of the guide member 400 with the tuft holes 131 in the head plate 130 so that as the bristle tufts 118 proceed through the delivery openings 414, the bristle tufts 118 enter into the tuft holes 131.

Thus, the bundle of bristles 301 is inserted through the insertion opening 403 of the guide member 403 and is divided into a plurality of bristle tufts 118 that are each positioned within a different one of the delivery passageways 412 of the guide member 400. The head plate 130 is either aligned with the guide member 403 at this stage, or prior to insertion of the bundle of bristles 301 into the insertion opening 403 of the guide member 400. The bristle tufts 118 are then pushed through the delivery passageways 412 of the guide member 400 until the bristle tufts 118 extend through the delivery openings 414 on the second surface 402 of the guide member 400. As the bristle tufts 118 extend through the delivery openings 414, the bristle tufts 118 pass into the tuft holes 131 of the head plate 130 (see FIG. 6B). Because each of the delivery passageways 412 and delivery openings 414 is aligned with a different one of the tuft holes 131, each of the bristle tufts 118 passes into a different one of the tuft holes 131. Thus, using the guide member 400 a single bundle of bristles 301 can be used to form multiple bristle tufts 118 that are mounted to the head 110 or head plate 130.

Figure 6C:
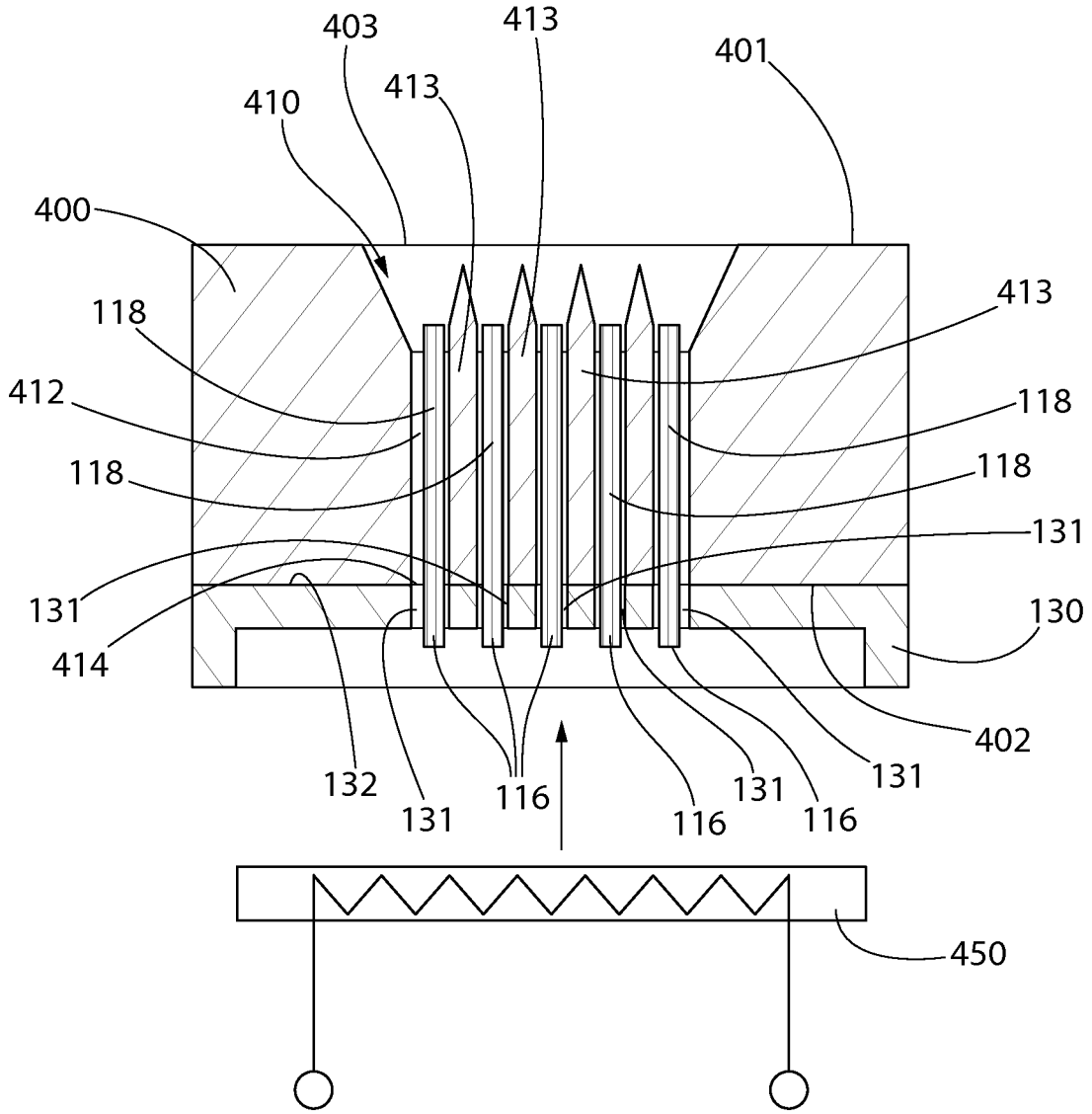
FIG. 6C is a schematic representation of heat being applied to anchor portions of the plurality of bristle tufts that are positioned within the head plate.
Figure 6D:
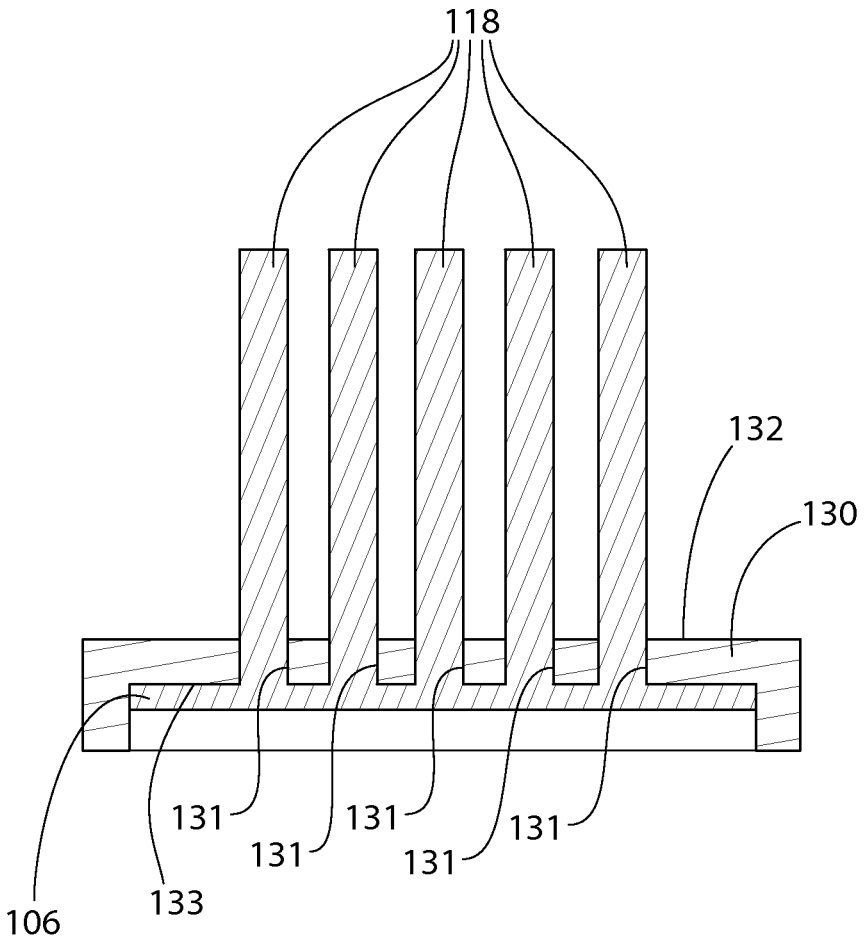
FIG. 6D is a schematic representation of the head plate having the plurality of bristle tufts extending therefrom.

Referring to FIGS. 6C and 6D, after the bristle tufts 118 are inserted into the different tuft holes 131, heat is applied to the anchor portions 116 of the bristles of the bristle tufts 118. In the exemplified embodiment, a heating element 450 is positioned close to or against the anchor portions 116 of the bristles of the bristle tufts 118 in order to melt the anchor portions 116 of the bristles of the bristle tufts 118 and form the melt matte 106. The heating element 450 may be formed from a heat conductive material and be electrically heated. However, the invention is not to be so limited and any known technique for heating the anchor portions of bristles to form a melt matte may be used.

After the melt matte 106 is formed, the guide member 400 can be separated or pulled away from the head plate 130, which will allow the head plate 130 with the bristle tufts 118 mounted thereto to remain (see FIG. 6D). The head plate 131 can then be mounted to the head 110 of the oral care implement 100 as has been described herein above. Alternatively, when the oral care implement 200 of FIGS. 7A-7C is used, after the melt matte 106 is formed, the tissue cleanser 140 or other structure can be molded or otherwise coupled to the rear surface of the head 210. Furthermore, after the melt matte 106 is formed, and either before or after the head plate 130 is mounted to the head 110, the bristle tufts 118 can be cut to a desired height if desired.

Thus, using the technique described herein, a plurality of the bristle tufts 118 can be formed with one bundle of bristles 301. Thus, with one movement of a toothbrush tufting machine, the bundle of bristles 301 can be selected from the supply of bristles 300 and inserted into the guide member 400 to form a plurality of distinct bristle tufts 118 on a head 110 or head plate 130 of an oral care implement 100. In the past, the machine would grab one bundle of bristles and insert that bundle of bristles into the head or head plate, and then grab another bundle of bristles and insert that bundle of bristles into the head or head plate, each bundle of bristles forming one distinct bristle tuft in its own distinct tuft hole. Using the techniques described herein, several distinct bristle tufts 118 can be mounted within several distinct tuft holes 131 within the head 110 or head plate 131 using one bundle of bristles 301. Thus, multiple distinct bristle tufts 118 can be mounted to the head 110 or head plate 131 in the same amount of time that it conventionally takes to mount one bristle tuft to a head or head plate.

Using the techniques described herein, oral care implements 100 can be manufactured with more distinct bristle tufts without compromising the output or quantity of oral care implements 100 made in a given period of time. Alternatively, oral care implements 100 can be manufactured with the same number of bristle tufts as with conventional oral care implements, except the quantity of oral care implements manufactured will increase. Specifically, the number of bristles in the bundle of bristles 301 (or pick) can be selected to be equal to the number of bristles in five distinct bristle tufts in conventional oral care implements. Then, when using the guide member 400, the five distinct bristle tufts of similar bristle density to conventional toothbrushes can be formed with the single bundle of bristles 301.

In one embodiment, the guide member 400 can be omitted and the head plate itself can take on the structure of the guide member 400 as described herein. Specifically, the head plate 130 may include the insertion opening, the bristle distribution passageway, the delivery passageways, and the dividers. In such an embodiment, the delivery passageways will form the tuft holes in the head plate 130. Thus, as the bundle of bristles is inserted into the insertion opening, the dividers will separate the bundle of bristles into bristle tufts, each of which will be positioned within one of the delivery passageways that forms one of the tuft holes in the head plate 130. In such an embodiment, the insertion opening may be formed into either the upper 132 or lower surface 133 of the head plate 130.

Referring to FIGS. 8A through 8D, various schematics illustrating the number of tuft holes or bristle tufts within a specifically dimensioned bounded area on the head of an oral care implement are provided. As noted above, using the techniques described herein above, oral care implements can be manufactured with smaller tuft holes than previously accomplished without compromising or reducing the expected output or quantity of oral care implements made in a given period of time. Thus, in one embodiment the invention is directed to an oral care implement having a handle and a head, the head having a first surface with a plurality of tuft holes 531 formed therein. Either one of the oral care implements 100, 200 can be used with the dimensions provided herein below.

Figure 8A:
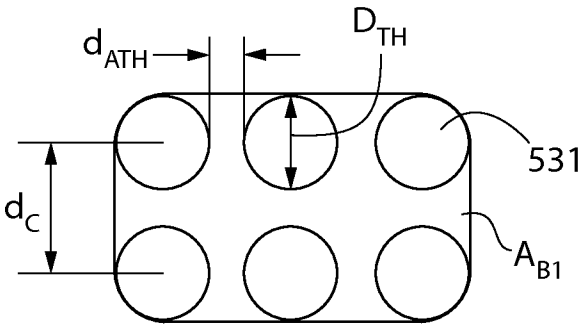
FIG. 8A is a schematic illustrating a number of tuft holes positioned within a singular bounded area on the head in accordance with one embodiment of the present invention.

Specifically, each of FIGS. 8A through 8D illustrates a portion of the head having tuft holes 531 thereon. Each one of the portions of the head depicted in FIGS. 8A through 8D has a different surface area, and thus a different number of the tuft holes 531 is provided in each of FIGS. 8A through 8D depending on the number of tuft holes 531 that fit within a particular area/portion of the head. Specifically, in each of FIGS. 8A through 8D, X number of tuft holes are provided within a singular bounded area $A_B$. In FIG. 8A, there are six tuft holes provided within a singular bounded area $A_{B1}$, in FIG. 8B there are four tuft holes provided within a singular bounded area $A_{B2}$, in FIG. 8C there are nine tuft holes provided within a singular bounded area $A_{B3}$, and in FIG. 8D there are two tuft holes provided within a singular bounded area $A_{B4}$. In certain embodiments, X is an integer that is greater than or equal to 2, each of the tuft holes 531 has a diameter $D_{TH}$ that is less than or equal to 1.2 mm, or more specifically less than or equal to 1.1 mm, and the equation $X/A_B$ is greater than or equal to 0.54. In each of the embodiments of FIGS. 8A through 8D, the tuft holes 531 have circular shapes. However, the invention is not to be so limited and the tuft holes 531 can have other shapes in other embodiments, such as being triangular, rectangular, square, hexagonal, or the like.

In certain embodiments, each of the plurality of tuft holes 531 has the diameter $D_{TH}$. Furthermore, adjacent ones of the tuft holes 531 are spaced apart by a distance $d_{ATH}$. In one embodiment, the diameter $D_{TH}$ of the tuft holes 531 is between 1.0 mm and 1.2 mm, and more specifically between 1.05 mm and 1.15 mm, and still more specifically approximately 1.1 mm. In another embodiment, the diameter $D_{TH}$ of the tuft holes 531 is less than 1.1 mm. Although the diameter $D_{TH}$ is described herein with regard to the tuft holes 531, in certain embodiments the diameter of the bristle tufts positioned within the tuft holes 531 is substantially the same as the diameter $D_{TH}$ of the tuft holes 531. Furthermore, in one embodiment the distance $d_{ATH}$ between adjacent ones of the tuft holes 531 is between 0.25 mm and 0.55 mm, more specifically between 0.3 mm and 0.5 mm, even more specifically between 0.35 mm and 0.45 mm, and still more specifically approximately 0.4 mm. Furthermore, the distance $d_C$ from the center of one tuft hole 531 to the center of an adjacent tuft hole 531 is between approximately 1.4 mm and 1.6 mm, and more specifically approximately 1.5 mm. In one specific embodiment $D_{TH}$ is approximately 1.1 mm, $d_C$ is approximately 1.5 mm, and $d_{ATH}$ is approximately 0.4 mm. Although the distances $d_{ATH}$, $d_C$ are described herein as being between adjacent tuft holes 531, the distances $d_{ATH}$, $d_C$ can also be the distances between adjacent bristle tufts that are positioned within the tuft holes 531. Although these dimensions are only provided in FIG. 8A, they are equally applicable to FIGS. 8B through 8D.

Figure 8B:
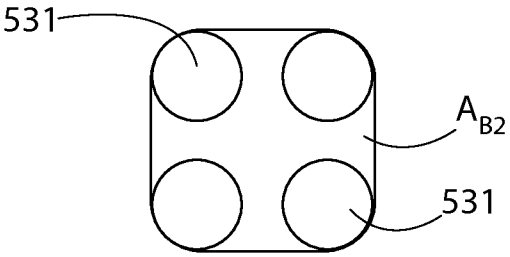
FIG. 8B is a schematic illustrating a number of tuft holes positioned within a singular bounded area on the head in accordance with another embodiment of the present invention.

In each of FIGS. 8A through 8D, a ratio of the number of tuft holes 531 to the singular bounded area $A_{B1}$, $A_{B2}$, $A_{B3}$, $A_{B4}$ falls within the range of 0.45 to 0.85 tuft holes per $mm^2$, more specifically 0.5 to 0.8 tuft holes per $mm^2$, and still more specifically 0.54 to 0.78 tuft holes per $mm^2$. Specifically, in FIG. 8A there are six tuft holes 531 provided within the singular bounded area $A_{B1}$, and the singular bounded area $A_{B1}$ is between approximately 10.2 $mm^2$ and 10.7 $mm^2$, more specifically between approximately 10.4 $mm^2$ and 10.5 $mm^2$, and still more specifically approximately 10.43 $mm^2$. In FIG. 8B there are four tuft holes 531 provided within singular bounded area $A_{B2}$, and the singular bounded area $A_{B2}$ is between approximately 6.3 $mm^2$ and 6.7 $mm^2$, more specifically between approximately 6.45 $mm^2$ and 6.55 $mm^2$, and still more specifically approximately 6.49 $mm^2$. Furthermore, in FIG. 8C there are nine tuft holes 531 provided within the singular bounded area $A_{B3}$, and the singular bounded area $A_{B3}$ is between approximately 16.3 $mm^2$ and 16.8 $mm^2$, more specifically between 16.5 $mm^2$ and 16.6 $mm^2$, and still more specifically approximately 16.54 $mm^2$. Finally, in FIG. 8D there are two tuft holes 531 provided within the singular bounded area $A_{B4}$, and the singular bounded area $A_{B4}$ is between approximately 2.4 and 2.8 $mm^2$, more specifically between 2.5 and 2.7 $mm^2$, and still more specifically approximately 2.6 $mm^2$.

More than four, six, nine, and two of the tuft holes 531 can be provided within the respective bounded areas $A_{B1}$, $A_{B2}$, $A_{B3}$, $A_{B4}$ in certain embodiments by decreasing the diameter $D_{TH}$ of the tuft holes 531 or decreasing the distance $d_{ATH}$ between the tuft holes 531. As noted above, each of the tuft holes 531 will be filled with a bristle tuft, and thus the ratio of the number of bristle tufts per $mm^2$ on the head is the same as the ratio of the number of tuft holes per $mm^2$ on the head. In the exemplified embodiment, the number of tuft holes 531 that fit within a particular area of the head is the number of full, not partial, tuft holes 531 that fit within that particular area. Thus, X is selected to be an integer. In other words, at least six full tuft holes 531 fit within the bounded area $A_{B1}$, at least four full tuft holes 531 fit within the bounded area $A_{B2}$, at least nine full tuft holes 531 fit within the bounded area $A_{B3}$, and at least two full tuft holes 531 fit within the bounded area $A_{B4}$ with no portion of any of the tuft holes 531 falling outside of the respective bounded area $A_{B1}$, $A_{B2}$, $A_{B3}$, $A_{B4}$.

Figure 8C:
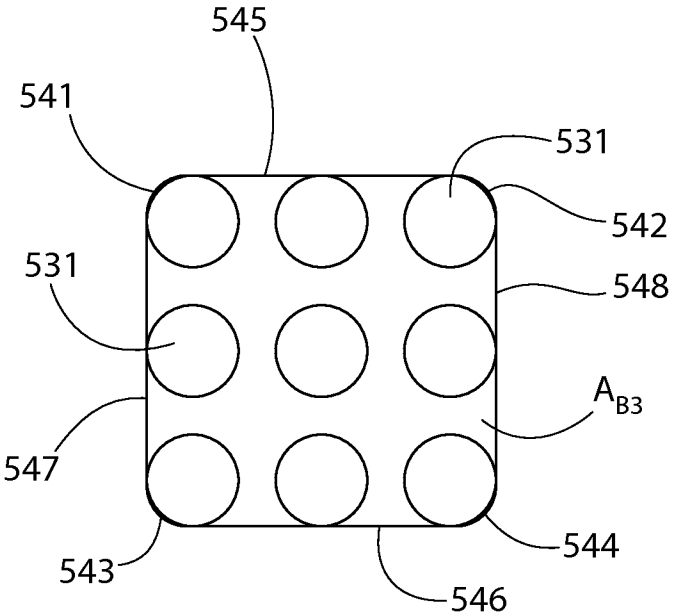
FIG. 8C is a schematic illustrating a number of tuft holes positioned within a singular bounded area on the head in accordance with yet another embodiment of the present invention.
Figure 8D:
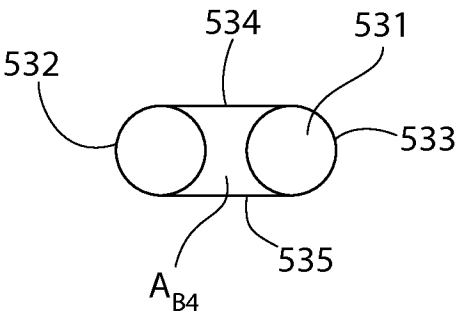
FIG. 8D is a schematic illustrating a number of tuft holes positioned within a singular bounded area on the head in accordance with yet another embodiment of the present invention.

The tuft holes 531 define a cumulative tuft hole area $A_{CTH}$ within each respective bounded area $A_B$. Specifically, as one particular example, each of the tuft holes 531 may have a diameter of 1.1 mm and an area of 0.95 $mm^2$. In the embodiment of FIG. 8A, the cumulative tuft hole area $A_{CTH}$ is approximately 5.7 $mm^2$, $X/A_{B1}$ is greater than or equal to 0.57 and $A_{CTH}/A_{B1}$ is greater than or equal to 0.54. In the embodiment of FIG. 8B, the cumulative tuft hole area $A_{CTH}$ is approximately 3.8 $mm^2$, $X/A_{B2}$ is greater than or equal to 0.61 and $A_{CTH}/A_{B2}$ is greater than or equal to 0.58. In the embodiment of FIG. 8C, the cumulative tuft hole area $A_{CTH}$ is approximately 8.55 $mm^2$, $X/A_{B3}$ is greater than or equal to 0.54 and $A_{CTH}/A_{B3}$ is greater than or equal to 0.51. In the embodiment of FIG. 8D, the cumulative tuft hole area $A_{CTH}$ is approximately 1.9 $mm^2$, $X/A_{B4}$ is greater than or equal to 0.76 and $A_{CTH}/A_{B4}$ is greater than or equal to 0.73.

In each of embodiments of FIGS. 8A through 8D, the single bounded area $A_{B1}$, $A_{B2}$, $A_{B3}$, $A_{B4}$ forms a closed geometry. Referring first to FIG. 8D, the single bounded area $A_{B4}$ is defined by: (1) a semi-circumference 532 of a first one of the two tuft holes 531; (2) a semi-circumference 533 of a second one of the two tuft holes 531; and (3) first and second lines 534, 535 that are parallel to one another and tangent to each of the first and second tuft holes 531 of the two tuft holes. Slightly differently, in each of FIGS. 8A through 8C (notated in FIG. 8C only to avoid clutter and repetitiveness), the bounded areas $A_{B1}$, $A_{B2}$, $A_{B3}$ are defined by: (1) a portion of a circumference 541 of a first one of the tuft holes positioned in a first corner of the singular bounded area $A_B$; (2) a portion of a circumference 542 of a second one of the tuft holes positioned in a second corner of the singular bounded area $A_B$; (3) a portion of a circumference 543 of a third one of the tuft holes positioned in a third corner of the singular bounded area $A_B$; (4) a portion of a circumference 544 of a fourth one of the tuft holes positioned in a fourth corner of the singular bounded area $A_B$; (5) first and second lines 545, 546 that are parallel to one another, the first line 545 being tangent to the first and second tuft holes and the second line 546 being tangent to the third and fourth tuft holes; and (6) third and fourth lines 547, 548 that are parallel to one another, the third line 547 being tangent to the first and third tuft holes and the fourth line 548 being tangent to the second and fourth holes. In either circumstance, the bounded area $A_B$ is a square or rectangular shaped closed geometry that has rounded corners.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A method of forming a bristle field for an oral care implement, the method comprising:

a) providing a bundle of bristles;

b) aligning the bundle of bristles with an insertion opening in a first surface of a head plate, the head plate comprising at least one bristle distribution passageway comprising a plurality of delivery passageways, each of the delivery passageways terminating in a delivery opening on a second surface of the head plate, wherein adjacent ones of the delivery passageways are separated from one another by a divider, each of the delivery passageways forming a tuft hole on the head plate; and c) inserting the bundle of bristles through the bristle distribution passageway so that the bundle of bristles is divided into a plurality of bristle tufts as a result of contact with the divider, each of the bristle tufts passing into a different one of the tuft holes on the head plate;

wherein the oral care implement comprises a body having a handle and a head, the head plate being a separate component from the body, the tuft holes being formed through the head plate from the first surface to the second surface, wherein each bristle of the bundle of bristles has a cleaning portion and an anchor portion, wherein the anchor portions of the bristles of the bundle of bristles protrude from one of the first and second surfaces of the head plate, the cleaning portions of the bristles of the bundle of bristles protruding from the other one of the first and second surfaces of the head plate, the method further comprising:

d) applying heat to the anchor portions of the bristles of the bundle of bristles to melt the anchor portions of the bristles of the bundle of bristles together to form a melt matte; and e) securing the head plate to the head so that the melt matte is positioned between the head and the head plate.

2. The method according to claim 1 wherein each of the tuft holes has a diameter of between 0.6 mm and 1.2 mm.

3. The method according to claim 1 wherein each of the tuft holes is spaced apart from adjacent ones of the tuft holes, and wherein each of the bristle tufts has an outer surface that is spaced apart from adjacent ones of the bristle tufts.

* * * * *